US005230423A

United States Patent [19]

Gellatly

[11] Patent Number: 5,230,423

[45] Date of Patent: Jul. 27, 1993

[54] ADVERTISING DISPLAY

[76] Inventor: Georgia L. Gellatly, 3462 Jefferson Ave., Ogden, Utah 84403

[21] Appl. No.: 877,850

[22] Filed: May 4, 1992

[51] Int. Cl.[5] ..... B65D 5/44

[52] U.S. Cl. ..... 206/45.14; 206/44 R; 211/132

[58] Field of Search ..... 206/44 R, 44.11, 45.19, 206/45.28, 45.29, 45.3, 45.14; 211/86, 126, 132, 195, 196, 205

[56] References Cited

U.S. PATENT DOCUMENTS

| | | | |
|---|---|---|---|
| 3,164,350 | 1/1965 | Taub | 206/44 R |
| 3,340,998 | 9/1967 | Wilson | 206/44 R |
| 3,999,662 | 12/1976 | Barnhardt | 206/44 R |
| 4,569,564 | 2/1986 | Ahmann | 206/44 R |
| 4,651,871 | 3/1987 | Scröters | 206/44 R |
| 4,813,536 | 3/1989 | Willis | 206/44 R |
| 4,938,343 | 7/1990 | Willis | 206/44 R |

FOREIGN PATENT DOCUMENTS

| | | | |
|---|---|---|---|
| 0634823 | 7/1963 | Belgium | 206/44 R |
| 0106898 | 7/1967 | Denmark | 206/44 R |

*Primary Examiner*—Jimmy G. Foster

[57] ABSTRACT

An advertising display having a cover skirt to fit over the usual storage and shipping box for goods and a top cover with a bottom to fit over and rest on the top of the storage and shipping box when the cover skirt is telescoped over the storage and display box. Dividers are provided to rest on the bottom of the top cover and to divide the display into compartments in which product may be placed for display.

1 Claim, 2 Drawing Sheets

ADVERTISING DISPLAY

FIELD OF THE INVENTION

This invention relates to point of sale display-type advertising and is particularly concerned with advertising displays to be used in conjunction with boxes in which goods to be marketed are shipped, stored, and displayed.

PRIOR ART

Many types of displays have been proposed and used in the past in connection with point-of-sale marketing of goods. For example, it is well known to use "headers", i.e. two or three dimensional, stand up posters that insert down into and that project upwardly from boxes or that attach to boxes in some fashion to extend upwardly to display an advertising message. It is also common to use such display boxes for product to be sold. Such display boxes are generally provided with an attractive exterior and frequently have an advertising message thereon. Sometimes the display boxes are scored or marked to be cut, so that when opened the goods therein are "on display".

The previously known display units with which I am familiar are quite suitable for point of sale display with many products. However, some products do not display well from even a display-type shipping box and the cost of such display boxes is high and must be included in the price to the purchaser of the goods.

OBJECTS OF THE INVENTION

Principal objects of the present invention are to provide a display system that will allow goods to be shipped and stored in standard, non-display type boxes and then to provide a cover skirt for only such box as may be placed at the point-of-sale location. A top cover has trays to hold product removed from the storage box and placed in the tray for display and an advertising header extending upwardly from and providing a back with such pictures, text and art-work, as may be desired.

FEATURES OF THE INVENTION

Principal features of the invention include a cover skirt made of cardboard, or the like, and dimensioned to telescope over a standard shipping and storage box. A top cover, sized to fit over and to close an upper end of the skirt, has compartments to receive a number of the products to be displayed. Both the skirt and the top cover are made to fold flat for storage and shipping.

In use, the storage box for the products being marketed and any products therein serves as a stable base for the display, as well as convenient storage at the point of sale. The skirt, removably and re-usably, surrounds the storage box and the top cover closes the top of the storage box, provides an organized display of the products and presents advertising to help sell the product.

Additional objects and features of the invention will become apparent to those skilled in the art to which the invention pertains from the following detailed description, drawing and claims.

THE DRAWING

In the drawing:

FIG. 1 is a perspective view of the display unit of the invention;

FIG. 2, a side elevation view;

FIG. 3, a rear elevation view; and

FIG. 4, an exploded perspective view.

DETAILED DESCRIPTION

Figure 1:
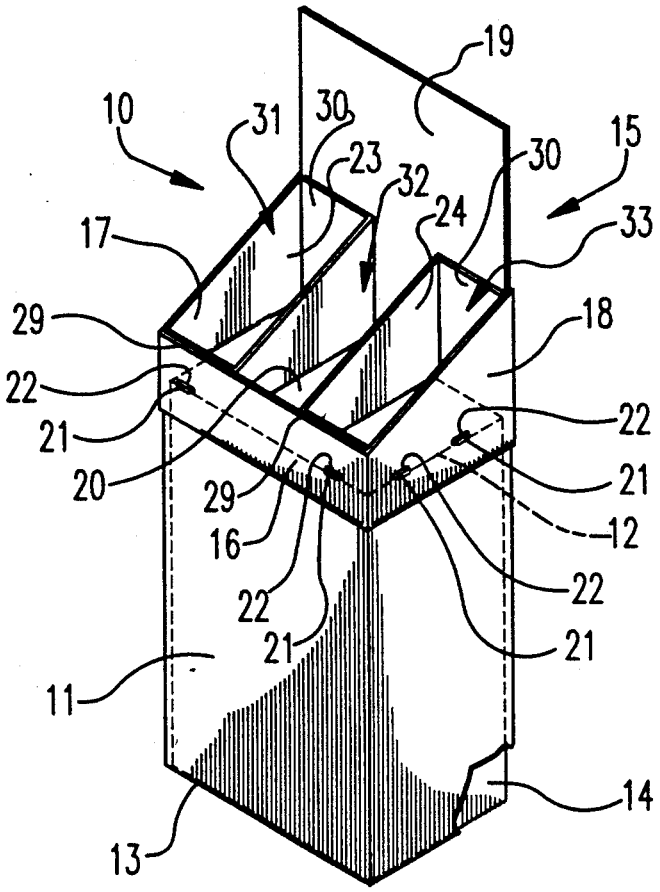
Figure 2:
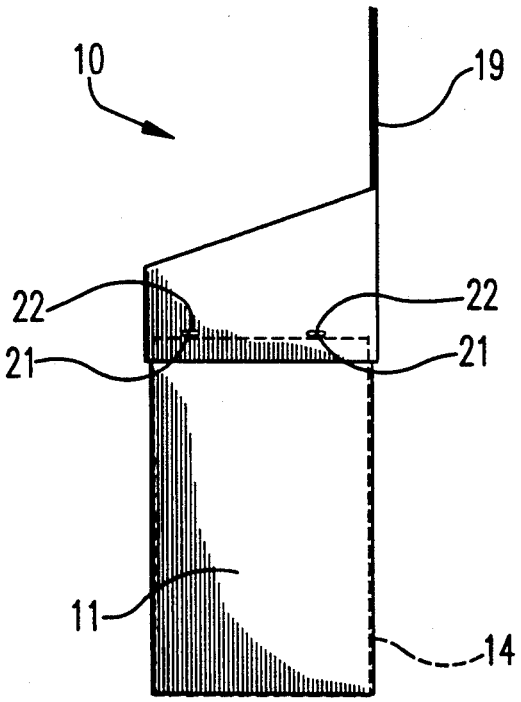
Figure 3:
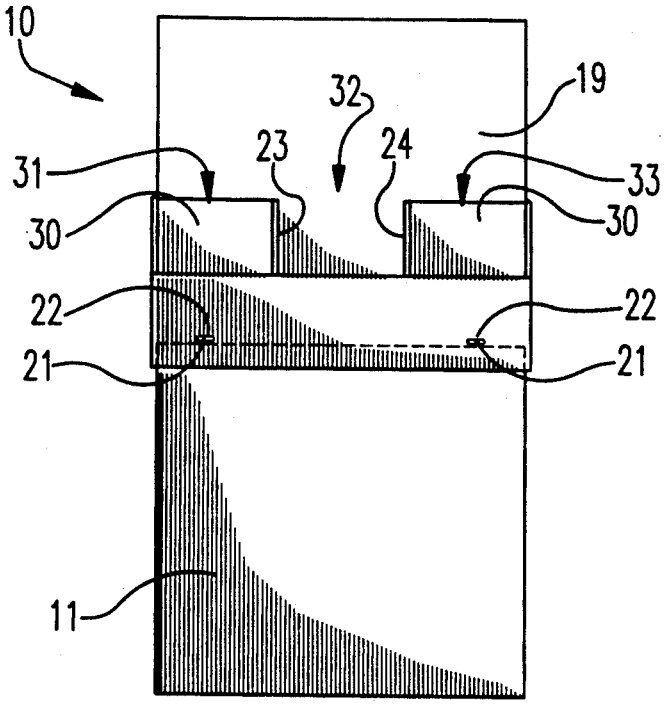
Figure 4:
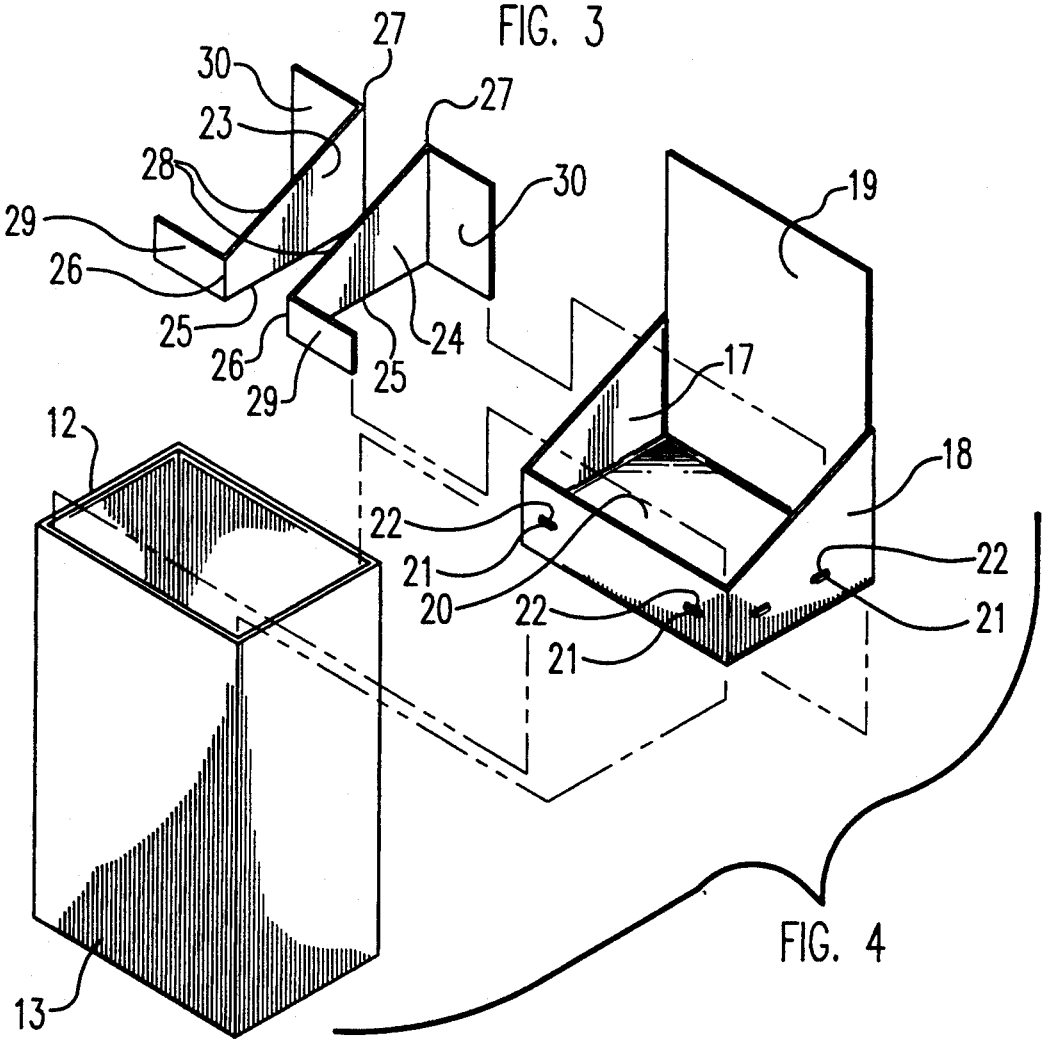

In the illustrated preferred embodiment of the invention, the advertising display of the invention is shown generally at 10. The display includes a cover skirt 11 that is of generally box-like configuration, but open at its top 12 and bottom 13. As shown best in FIG. 1, the cover skirt telescope over a standard storage and shipping box 14 for products to be sold.

A top cover 15 is formed with a front wall 16, parallel side walls 17 and 18 and a rear wall 19. The side walls 17 and 18 have top edges that from the top edge of front wall 16 upwardly to intermediate the upwardly extending length of rear wall 19.

A bottom 20 fits within the front, side and rear walls and is held in place by tabs 21 projecting out from the surrounding edge of the bottom and into slots 22 provided therefor in each of the front, side and rear walls.

Divider panels 23 and 24 each have a bottom edge 25 that will extend fully across the bottom 20, a front edge 26 that extends upwardly against the front wall 16, a rear edge 27 that extends upwardly against the rear wall 19 and a top wall 28 extending from a top of front edge 26 to a top of rear edge 27. A front fold piece 29 extends from each front edge 26 and a rear fold piece 30 extends from each rear edge to be placed flat against the front and rear walls 16 and 19, respectively and to engages a side wall 17 or 18. The divider panels thus stand on the bottom 20 and serve as partitions between compartments 31, 32, and 33 in the top cover.

In use, the top cover 15 is assembled and product to be sold is removed from the storage and shipping container 14 and is placed in the compartments 31–33 for display. The top cover is placed over the open top end of the cover skirt 11 and the storage and shipping container 14. The compartments 31–33 are formed and filled and subsequently re-filled from the shipping and storage container 14 as the compartments are emptied.

Although a preferred embodiment of my invention has been herein disclosed, it is to be understood that the present disclosure is by way of example and that variations are possible without departing from the subject matter coming within the scope of the following claims and a reasonable equivalency.

I claim:

1. An advertising display comprising a shipping and storage container for goods to be sold;

a cover skirt, foldable to a substantially flat condition, surrounding said shipping and storage container and having an open bottom end and an open top end;

a top cover sized to telescope over said cover skirt, said top cover having a bottom overlying and resting on an open top end of said shipping and storage container and said open top end of said cover skirt, a plurality of compartments formed on said bottom of said top cover and a rear wall extending upwardly from said bottom to display an advertising message thereon, and said top cover bottom and compartment walls being flat and removable, whereby said top cover is foldable to a substantially flat condition.

* * * * *